US009306322B2

(12) United States Patent
Bhimavarapu et al.

(10) Patent No.: US 9,306,322 B2
(45) Date of Patent: Apr. 5, 2016

(54) PATIENT SUPPORT APPARATUS CONNECTORS

(71) Applicant: Stryker Corporation, Kalamzoo, MI (US)

(72) Inventors: Krishna Sandeep Bhimavarapu, Portage, MI (US); Michael Joseph Hayes, Kalamazoo, MI (US); Aaron Douglas Furman, Kalamzoo, MI (US); Abel Laban-Dick Manumbu, Berrien Springs, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 13/790,762

(22) Filed: Mar. 8, 2013

(65) Prior Publication Data

US 2014/0057463 A1 Feb. 27, 2014

Related U.S. Application Data

(60) Provisional application No. 61/692,256, filed on Aug. 23, 2012.

(51) Int. Cl.

| | |
|---|---|
| ***A47B 7/02*** | (2006.01) |
| ***H01R 13/62*** | (2006.01) |
| ***A61G 7/018*** | (2006.01) |
| ***A61G 7/00*** | (2006.01) |
| ***A61G 13/02*** | (2006.01) |
| *H01R 107/00* | (2006.01) |

(52) U.S. Cl.

CPC ..... *H01R 13/6205* (2013.01); *A61G 7/00* (2013.01); *A61G 7/018* (2013.01); *A61G 13/02* (2013.01); *H01R 2107/00* (2013.01)

(58) Field of Classification Search

CPC ..... A61G 7/00; A61G 7/018; A61G 7/05; A61G 7/08; A61G 13/00; A61G 13/02; A61G 13/10; H10R 13/6205

See application file for complete search history.

(56) References Cited

U.S. PATENT DOCUMENTS

| | | | | |
|---|---|---|---|---|
| 3,818,516 | A * | 6/1974 | Hopper et al. | 5/611 |
| 4,636,706 | A * | 1/1987 | Bowman et al. | 322/28 |
| 5,425,148 | A * | 6/1995 | Ashcraft et al. | 5/507.1 |
| 5,987,670 | A * | 11/1999 | Sims et al. | 5/600 |
| 7,311,526 | B2 | 12/2007 | Rohrbach et al. | |
| 7,399,205 | B2 | 7/2008 | McNeely et al. | |
| 7,779,493 | B2 | 8/2010 | Lemire et al. | |
| 7,986,242 | B2 | 7/2011 | Dixon et al. | |
| 8,006,332 | B2 | 8/2011 | Lemire et al. | |
| RE43,193 | E * | 2/2012 | Osborne et al. | 5/618 |

(Continued)

*Primary Examiner* — David E Sosnowski

(74) *Attorney, Agent, or Firm* — Warner Norcross & Judd LLP

(57) ABSTRACT

A patient support apparatus—such as a bed, stretcher, cot, chair, operating table, or the like—includes at least one electrical connector having at least one magnet integrated therein for magnetically retaining the connector with a complementary connector. The connector and the complementary connector may be designed such that they are retained together substantially only by magnetic forces, rather than frictional forces. Multiple magnets may be included within the connectors such that the connectors only couple together in a specific orientation. The connector may connect the patient support apparatus to a mattress positioned thereon, to a wall outlet, to a removable footboard or headboard, to a removable pedestal, or to other devices. The connector may include an internal safety switch that turns on a high voltage connection only when a low voltage connection is established.

12 Claims, 5 Drawing Sheets

(56) References Cited

U.S. PATENT DOCUMENTS

| | | | | |
|---|---|---|---|---|
| 8,290,569 | B2 * | 10/2012 | Piron et al. | 600/415 |
| 8,707,483 | B2 * | 4/2014 | Richards et al. | 5/600 |
| 2003/0009952 | A1 * | 1/2003 | Gallant et al. | 52/36.4 |
| 2006/0179571 | A1 * | 8/2006 | Newkirk | 5/600 |
| 2006/0277683 | A1 * | 12/2006 | Lamire et al. | 5/600 |
| 2007/0130692 | A1 * | 6/2007 | Lemire et al. | 5/618 |
| 2007/0157385 | A1 * | 7/2007 | Lemire et al. | 5/600 |
| 2007/0163045 | A1 | 7/2007 | Becker et al. | |
| 2008/0109964 | A1 * | 5/2008 | Flocard et al. | 5/713 |
| 2011/0210833 | A1 | 9/2011 | McNeely et al. | |
| 2012/0042451 | A1 * | 2/2012 | Jones et al. | 5/618 |
| 2012/0144587 | A1 * | 6/2012 | Andrienko | 5/618 |
| 2012/0148195 | A1 | 6/2012 | Umeno | |
| 2012/0151678 | A1 * | 6/2012 | Richards | 5/613 |
| 2012/0164849 | A1 * | 6/2012 | Lee et al. | 439/39 |
| 2012/0291200 | A1 * | 11/2012 | Dixon et al. | 5/600 |
| 2014/0057463 | A1 * | 2/2014 | Bhimavarapu et al. | 439/39 |
| 2014/0237721 | A1 * | 8/2014 | Lemire et al. | 5/510 |
| 2014/0259410 | A1 * | 9/2014 | Zerhusen et al. | 5/600 |

* cited by examiner

PATIENT SUPPORT APPARATUS CONNECTORS

CROSS-REFERENCE TO RELATED APPLICATIONS

This application claims priority to U.S. provisional patent application Ser. No. 61/692,256 filed Aug. 23, 2012 by applicants Krishna Bhimavarapu et al. and entitled PATIENT SUPPORT APPARATUS CONNECTORS, the complete disclosure of which is incorporated herein by reference.

BACKGROUND OF THE INVENTION

The present invention relates to patient support apparatuses—such as bed, cots, stretchers, and the like—and more particularly to electrical connectors that may be used with such apparatuses for supplying power and/or data to and/or from such apparatuses.

Modern day patient support apparatuses typically have one or more components that require electrical power. Such components include actuators, such as motors, pumps, and the like, as well as sensors, user interfaces, and control circuitry that oversees the operation of the one or more actuators. For example, modern hospital beds often include one or more user interfaces that allow a caregiver to control the movement of various portions of the bed, as well as to set alerts, and to monitor conditions of the bed (such as whether a patient has exited the bed or not). In many cases, this user interface is connected to the components it controls via an electrical cable or a connector. Such cables or connectors may extend between the patient support apparatus itself and the mattress positioned thereon, between the mattress and a pendant that controls the mattress, between the patient support apparatus and an external device (such as, but not limited to, a wall outlet for power delivery and/or for a network connection), or between any other components where one of the components is not permanently coupled to the other component.

In the past, the temporary electrical connection between two components related to patient support apparatuses has been carried out by friction fitting connectors. Such connectors may be integrated into, or attached to, the ends of an electrical cable. The connectors are physically designed to be held together by a frictional coupling that resists separation. In some cases, a user may forget that the two components are coupled together and attempt to move one of the coupled components. This may end up damaging one or both of the connectors. In other cases, it can be difficult to align the connectors precisely. This difficulty in alignment may lead to a user forcing together the two connectors when they are not properly aligned, which can lead to damage to one or both of the connectors, or it can lead to an improper or poor electrical connection between the connectors.

SUMMARY OF THE INVENTION

The various aspects and embodiments of the present invention provide improved connectors that help to reduce the possibility of damage due to misalignment, damage due to movement of one component while the connectors are still coupled, and/or poor electrical connections due to improper or incomplete alignment. The various aspects and embodiments also or alternatively provide visual indication to a user that a good electrical connection has been established. In still other embodiments, safety features are included that reduce the possibility of unintended contact with exposed high voltage or high current pins, wires, or other electrical conduits within the connectors.

According to one embodiment, a patient support apparatus is provided that includes a patient support surface adapted to support a patient thereon, an electrical control system, an electrical connector, and a magnet incorporated into the electrical connector. The electrical control system is adapted to control a plurality of features of the patient support apparatus. The electrical connector is in electrical communication with the electrical control system and is adapted to releasably couple to a complementary connector in order to transfer electrical power therebetween. The magnet is adapted to releasably hold the electrical connector and the complementary connector together and to assist in aligning the connector with the complementary connector.

In other embodiments, the connector and complementary connector are adapted to transfer data therebetween in addition to power. The electrical connector may be positioned at a foot end of the patient support apparatus and the complementary connector may be incorporated into a footboard that is attachable and detachable to the patient support apparatus. The footboard may include a user interface for enabling a user to control at least one aspect of the electrical control system, wherein the user interface communicates electrically with the electrical control system via the electrical connector.

The complementary connector may be attached to a mattress and the electrical control system may be configured to communicate with the mattress when the complementary connector and the electrical connector are connected together. Alternatively, the complementary connector may be attached to a wall outlet at its end that is opposite to the electrical connector.

The electrical connector may be integrated into a mattress positioned on the patient support apparatus and the complementary connector may be electrically coupled to a pendant that is supportable on the patient support apparatus. The pendant may provide a user interface adapted to allow a user to control at least one aspect of the electrical control system.

The patient support apparatus may be one of a bed, a stretcher, a cot, and a recliner.

The electrical control system may include the ability to raise and lower the patient support surface and to pivot at least one section of the patient support surface. A second magnet may be incorporated into the electrical connector wherein the second magnet assists in releasably holding together, and aligning, the electrical connector and the complementary connector. In some embodiments, the connector and complementary connector are held together solely by magnetic force and without any friction fitting.

In still other embodiments, the electrical connector may include a first conductor, a second conductor adapted to carry a voltage higher than a voltage carried by the first conductor; a sensor adapted to detect when the first conductor is electrically connected to the complementary connector; and a switch that turns on electrical power to the second conductor when the sensor detects that the first conductor is electrically coupled to the complementary connector and that turns off electrical power to the second conductor when the sensor detects that the first conductor is electrically disconnected from the complementary connector.

The connector may include a plurality of pins or a plurality of receptacles, or a combination thereof. The connector may be integrated into an electrical cable, and the electrical cable may be extendable out of, and retractable into, a housing. An automatic retraction device may be included within the housing that automatically retracts the electrical cable into the housing when activated by a user.

An indicator may be included on the connector or on the patient support apparatus that provides a visual indication when the connector and the complementary connector are electrically coupled together. In some embodiments, the indicator may be a light emitting diode that is incorporated into the connector and that is adapted to emit a light when the connector and the complementary connector are electrically coupled together.

The magnet in the connector may be designed to magnetically couple to the complementary connector such that at least 40 pounds of force is required to overcome the magnetic connection between the connector and the complementary connector.

According to yet another embodiment, a patient support apparatus is provided that includes a patient support surface, an electrical control system, an electrical connector, and a switch. The patient support surface is adapted to support a patient thereon. The electrical control system controls a plurality of features of the patient support apparatus. The electrical connector is in electrical communication with the electrical control system and is adapted to releasably couple to a complementary connector in order to transfer electrical power therebetween. The electrical connector includes a first conductor, a second conductor adapted to carry a voltage higher than a voltage carried by the first conductor, and a sensor adapted to detect when the first conductor is electrically connected to the complementary connector. The switch turns on electrical power to the second conductor when the sensor detects that the first conductor is electrically connected to the complementary connector and turns off electrical power to the second conductor when the sensor detects that the first conductor is electrically disconnected from the complementary connector.

According to other embodiments, the patient support apparatus includes a first magnet integrated into the electrical connector that is adapted to releasably and magnetically couple to a second magnet integrated into the complementary connector. A light emitting diode may be incorporated into the connector that is adapted to emit a light when the connector and the complementary connector are electrically connected together. The connector and the complementary connector may be designed to be held together solely by magnetic force and without any friction fitting. The connector may be positioned in any one or more of the following locations: (1) a foot end of the patient support apparatus where it is able to be releasably coupled to a footboard having the complementary connector; (2) at a location on the patient support apparatus where it is able to be releasably coupled to a mattress or mattress cable having the complementary connector; (3) at a location coupled to the mattress where it is able to be releasably coupled to a pedestal or pendant having the complementary connector; (4) at a location on the patient support apparatus where it is able to be releasably coupled to a wall connectable cable having the complementary connector; and (5) at an end of a patient support coupled connector where it is able to be releasably coupled to a wall outlet having the complementary connector.

According to still another embodiment, a method of communicating electrical power and data between a patient support apparatus and a secondary device is provided. The method includes providing a first electrical connector on the patient support apparatus that includes a first magnet incorporated therein; providing a second electrical connector on the secondary device that includes a second magnet incorporated therein; and bringing the first and second electrical connectors into a physical proximity close enough to allow the first and second magnets to magnetically retain the first and second electrical connectors together.

In other embodiments, the method includes providing a visual indication when the first and second electrical connectors are electrically coupled together. The method may also include automatically switching on electrical power on a conductor of the first or second electrical connector when the first and second electrical connectors are coupled together, and automatically switching off electrical power on the conductor when the first and second electrical connectors are not coupled together. The method may also include transmitting data via the first and second electrical connectors that is used for controlling the operation of a mattress positioned on the patient support apparatus. Still further, the method may include connecting one of the first and second electrical connectors to a footboard of the patient support apparatus and connecting the other one of the first and second electrical connectors to the patient support apparatus, whereby the electrical connectors make electrical contact when the footboard is coupled to the patient support apparatus and the electrical connectors disconnect when the footboard is removed from the patient support apparatus. The method may further include positioning the first and second magnets in the first and second connectors in such a manner so that the magnets magnetically resist physical coupling of the first and second connectors in an undesired orientation.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and is capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments and/or in the claims. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENT

Figure 1:
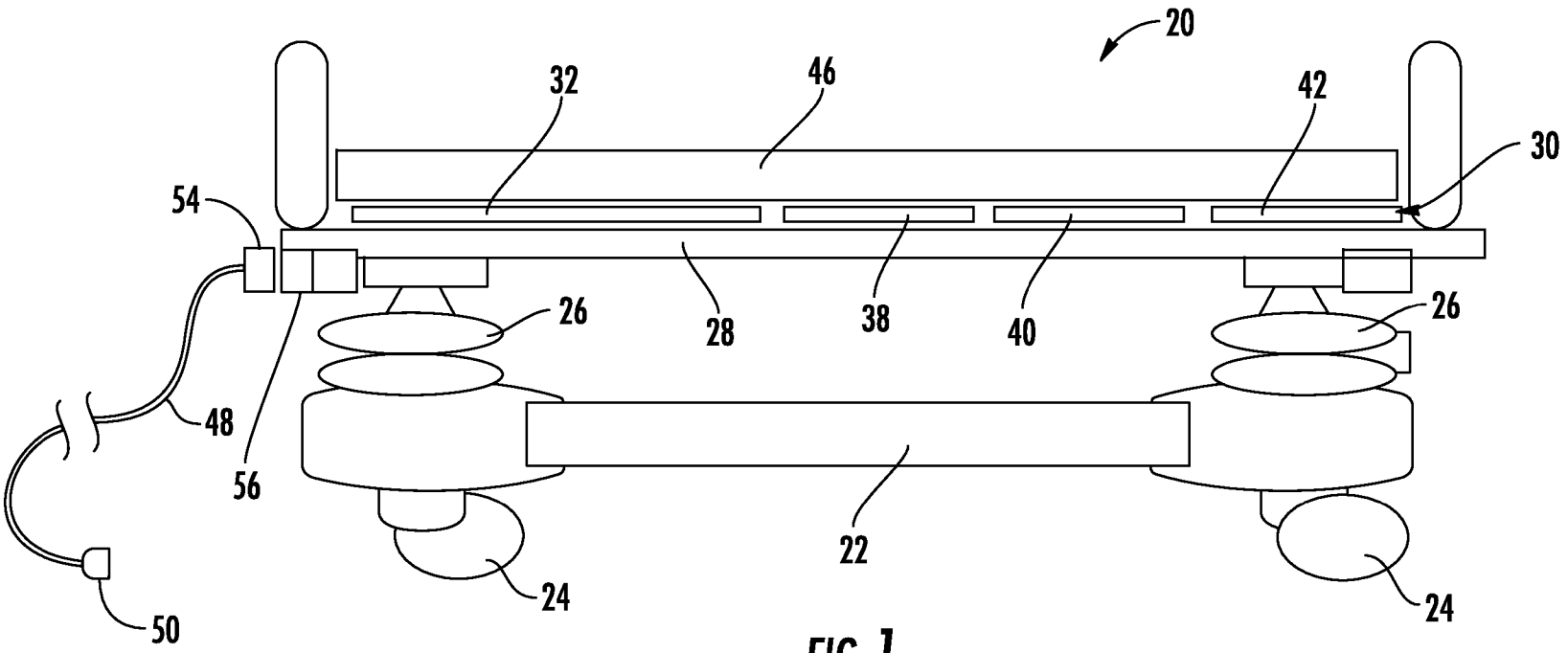
FIG. 1 is a side, elevational view of an illustrative patient support apparatus that may include one or more electrical connectors.

A patient support apparatus 20 according to a first embodiment is shown in FIG. 1. While patient support apparatus 20 is illustrated in FIG. 1 as a hospital bed, it will be understood that patient support apparatus 20 could alternatively take on the form of a stretcher, a cot, a surgical table, a recliner, or any other structure that is adapted to support a patient. In general, patient support apparatus 20 includes a base 22 having a plurality of wheels 24, a pair of elevation adjustment mechanisms 26 supported on said base, a frame or litter 28 supported on said elevation adjustment mechanisms, and a patient support deck 30 supported on said frame. Patient support apparatus 20 may further include a headboard 32 and a footboard 34.

Elevation adjustment mechanisms 26 are adapted to raise and lower frame 28 with respect to base 22. Elevation adjustment mechanisms 26 may be hydraulic actuators, electric actuators, or any other suitable device for raising and lowering frame 28 with respect to base 22. In some embodiments, elevation adjustment mechanisms 26 are operable independently so that the orientation of frame 28 with respect to base 22 is adjustable.

Frame 28 provides a structure for supporting patient support deck 30, headboard 32, and footboard 34. Patient support deck 30 is adapted to provide a surface on which a mattress 46, or other soft cushion, is positioned so that a patient may lie and/or sit thereon. Patient support deck 30 is made of a plurality of sections, one or more of which are pivotable about generally horizontal pivot axes. In the embodiment shown in FIG. 1, patient support deck 30 includes a head section 36, a seat section 38, a thigh section 40, and a foot section 42. Head section 36, which is also sometimes referred to as a Fowler section, is pivotable between a generally horizontal orientation (shown in FIG. 1) and a plurality of raised positions (not shown in FIG. 1). Thigh section 40 and foot section 42 may also be pivotable about horizontal pivot axes.

A plurality of side rails 44 (FIG. 7) may also be coupled to frame 28. If patient support apparatus 20 is a bed, there may be four such side rails, one positioned at a left head end of frame 28, a second positioned at a left foot end of frame 28, a third positioned at a right head end of frame 28, and a fourth positioned at a right foot end of frame 28. If patient support apparatus 20 is a stretcher or a cot, there may be fewer side rails. In other embodiments, there are no side rails on patient support apparatus 20. Regardless of the number of side rails, such side rails are movable between a raised position in which they block ingress and egress into and out of patient support apparatus 20, and a lowered position in which they are not an obstacle to such ingress and egress.

The general construction of any of base 22, elevation adjustment mechanisms 26, frame 28, patient support deck 30, headboard 32, footboard 34, and/or side rails 44 may take on any known or conventional design, such as, for example, that disclosed in commonly assigned, U.S. Pat. No. 7,690,059 issued to Lemire et al., and entitled HOSPITAL BED, the complete disclosure of which is incorporated herein by reference; or that disclosed in commonly assigned U.S. Pat. publication No. 2007/0163045 filed by Becker et al. and entitled PATIENT HANDLING DEVICE INCLUDING LOCAL STATUS INDICATION, ONE-TOUCH FOWLER ANGLE ADJUSTMENT, AND POWER-ON ALARM CONFIGURATION, the complete disclosure of which is also hereby incorporated herein by reference. The construction of any of base 22, elevation adjustment mechanisms 26, frame 28, patient support deck 30, headboard 32, footboard 34 and/or the side rails may also take on forms different from what is disclosed in the aforementioned patent and patent publication.

Patient support apparatus 20 typically includes a number of components that require electrical power. Such components often include one or more motors that power the pivoting of any one or more of head section 36, seat section 38, thigh section 40 and/or foot section 42, as well as one or more electric motors that either mechanically power elevation adjustment mechanisms 26, or that pump hydraulic fluid for operating elevation adjustment mechanisms 26. Patient support apparatus 20 may further include one or more components that either receive data from external sources, or that transmit data to external sources. Such data transfer commonly takes place between the support apparatus 20 and a nurse call system installed in a healthcare facility; between the support apparatus 20 and a healthcare computer network; between support apparatus 20 and another medical device; or between support apparatus 20 and a detachable pendant or pedestal supported on support apparatus 20 for controlling one or more structures related to the therapy and/or treatment of the patient. As one example, a pedestal can be used for controlling the inflation and deflation of mattress 46. Such control may be carried out to effect percussion therapy, to turn a patient, to reduce the likelihood of bed sores, and/or for other reasons. One example of a commercially available mattress that is able to be controlled by a pendant that is removably coupled to a bed is the Stryker XPRT Therapy Mattress module 2950, available from Stryker Corporation of Kalamazoo, Mich.

In order to transfer power and/or data to and from patient support apparatus 20 to other objects, patient support apparatus 20 includes an electrical cable 48 having an outlet end 50 that is adapted to be plugged into a wall outlet, or other object having a mating receptacle. The wall outlet, or other object having a mating receptacle, supplies electrical power to patient support apparatus 20 and/or it carries data between patient support apparatus 20 and an information system 52 that is in electrical communication with the wall outlet, or other object having a mating receptacle. The information system 52, as mentioned above, may be a nurse call system, a hospital computer network, or an intermediate computer or computer device that is either directly, or indirectly, in communication with the hospital computer network, or any other electronic device to which information is desirably exchanged with patient support apparatus 20.

Electrical cable 48 able to be coupled to patient support apparatus 20 via a connector 54 that matingly engages a complementary connector 56 that is integrated into support apparatus 20. While many of the figures, including FIG. 1, show connector 54 and complementary connector 56 as being spaced apart, this is for purposes of illustration only. In actual practice, connector 54 and complementary connector 56, when connected together, are in physical contact with each other such that electrical power and/or electrical data travels via one or more wire connections between the two. Further, connector 54 and complementary connector 56 are configured such that they are able to be disconnected from each other in a manner that reduces physical damage that might otherwise occur if support apparatus 20 is inadvertently moved without unplugging outlet end 50 from the wall outlet, or other object having a mating receptacle.

FIGS. 2-6 illustrate in greater detail several different configurations and embodiments for connector 54 and/or complementary connector 56. In the embodiment shown in FIG. 2, connector 54 includes twelve electrical pins 58 that are adapted to insert into twelve corresponding receptacles (not shown) on complementary connector 56. Any one or more of pins 58 carry electrical signals that are transferred between support apparatus 20 and information system 52. One or more of pins 58 may also carry electrical power for supplying electrical power to support apparatus 20. The supply of such power to support apparatus 20 may be a partial electrical supply, in which case additional electrical power may be supplied by other means, or it may be a complete electrical supply, in which case no additional sources of electricity may be needed for support apparatus 20.

Figure 2:
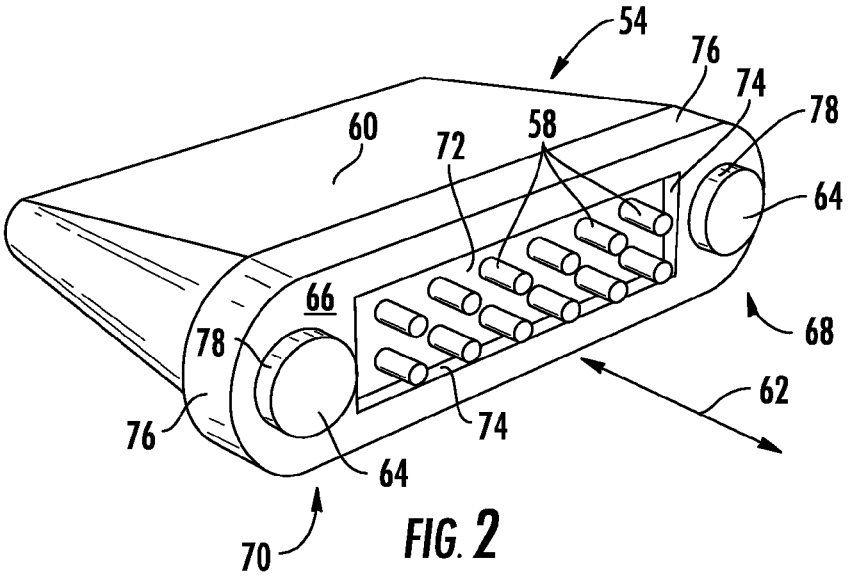
FIG. 2 is a perspective view of a first embodiment of an electrical connector.

The number of pins 58 illustrated in FIG. 2 is for purposes of illustration only. Connector 54 may include any number of pins for electrically coupling to complementary connector 56. Further, the arrangement of pins 58 shown in FIG. 2 is also for purposes of illustration only. Whether arranged in two parallel rows having an even number of pins 58—such as is shown in FIG. 2—or in a greater or fewer number of rows having the same or different numbers of pins 58, or in still other arrangements, the configuration of pins 58 in connector 54 may be implemented in any desirable manner.

The size and dimensions of pins 58 may also be changed from that shown in FIG. 2. In generally, the length and dimensions of pins 58 may be chosen such that they are short enough, and resilient enough, that they are unlikely to be damaged, or cause damage to the corresponding receptacles of complementary connector 56, when a breaking apart force is applied due to a person forgetting to deliberately separate connectors 54 and 56 prior to moving one of the items to which either connector 54 or 56 is attached. Thus, pins 58 are ideally chosen to be short enough and/or strong enough to resist damage if connectors 54 and 56 are forced apart due to twisting, bending, or other forces that are transverse to the alignment direction of connectors 54 and 56 (e.g. direction 62 in FIG. 2).

In some embodiments, pins 58 are spring loaded pins that are capable of flexing inward and outward along their longitudinal axis. In other words, pins 58 are adapted to move inward and outward from a connector housing 60 in a direction generally parallel to direction 62 in FIG. 2. Such spring loading is carried out by one or more springs coupled to the interior end of pins inside of housing 60. Typically, such a spring or springs exerts an outward force that urges the pins 58 away from housing 60. When connector 54 is physically coupled to complementary connector 56, the dimensions of the receptacles in complementary connector 56 are slightly shallower than the exposed length of pins 58 in connector 54. This shallower depth causes the conductive metal inside of the receptacles to urge pins 58 inward into housing 60 a small amount in opposition to the force of the one or more springs. The one or more springs therefore create a biasing force when connectors 54 and 56 are physically coupled together that urges each pin 58 into physical contact with the conductive metal inside each of the receptacles of complementary connector 56.

Still further, connector 54 may be modified to have one or more receptacles for receiving pins 58, rather than pins. Connector 54 may be further modified to have a combination of pins 58 and receptacles. Connector 54 and complementary connector 56 therefore may refer to either portion of the connective unit, and it does not matter which of the two connectors 54 and 56 includes pins 58 and which of the two units includes receptacles for pins 58, or whether they each include a combination of pins and receptacles, or whether they include other electrical contacting structures besides pins and receptacles. Thus, although FIG. 1 shows complementary connector 56 fixedly attached to, and/or integrated into support apparatus 20, while connector 54 is selectively attachable thereto and detachable therefrom, it will be understood that the position of connector 54 and complementary connector 56 could be switched. That is, connector 54 could be fixedly attached to support apparatus 20 while complementary connector 56 could be integrated into cable 48. Still further, it will be understood that in all of the drawings and examples described herein, the position of connector 54 and complementary connector 56 could be reversed.

Connector 54 of FIG. 2 further includes a plurality of magnets 64 that are positioned on a face 66 of housing 60. Magnets 64 are provided to create a magnetic coupling between connector 54 and complementary connector 56 that is sufficiently strong to retain the two connectors 54 and 56 together. Complementary connector 54 therefore includes a corresponding number of magnets 64 that are positioned in corresponding locations on complementary connector 56 and that are of opposite magnetic polarity. In some embodiments, magnets 64 are sized and/or configured such that a separation force of at least forty pounds is required to pull apart connector 54 and complementary connector 56 when they are magnetically coupled together. In other embodiments, magnets 64 are sized and/or configured to require greater or smaller amounts of force than forty pounds to pull them apart. The amount of force required for separation may be chosen based upon the function of the connector, its location relative to support device 20, and/or the object in which complementary connector 56 is integrated into, or otherwise connected to. The materials of magnets 64 are any conventional magnetic materials. In some embodiments, neodymium is used as the magnetic material, although it will be understood that other types of materials may also or alternatively be used.

Magnets 64 may be oriented such that each one has the same magnetic pole facing outward from face 66, or they may be arranged such that one has its north magnetic pole facing outward from face 66 and the other has its south magnetic pole facing outward from face 66. In still other embodiments, magnets 64 of FIG. 2 could be combined into a single magnet wherein one of its poles faced outward on a first side 68 of face 66 and the other of its poles faced outward on a second side 70 of face 66. Still further, greater or fewer numbers of magnetic poles could be positioned on or adjacent to face 66 of connector 54 than the two shown in FIG. 2.

When two or magnets 64 are included in connector 54 and of opposite magnetic polarity, connector 54 will resist coupling with complementary connector 56 unless complementary connector 56 is turned to the specific orientation in which its magnets 64 of opposite polarity are aligned with the magnets 64 of connector 56. This resistance is due to the magnetic repulsion of the same type of magnetic poles to each other. Thus, for example, if connector 54 has a north magnetic pole on first side 68 of face 66 and a south magnetic pole on the second side 70 of face 66, complementary connector 56 will only magnetically couple thereto if it is turned so that its south magnetic pole magnet aligns with first side 68 and its north magnetic pole aligns with second side 70 of connector 54. By the appropriate selection and positioning of magnetic poles, connectors 54 and 56 may be designed to magnetically couple together at only a single specific orientation of one with respect to the other, or they may be designed to allow magnetic coupling at a plurality of different orientations. Indeed, if connectors 54 and 56 utilize ring magnets, or other arrangements of magnets with the same polarity and in sufficient number to create magnetic coupling at all orientations, it is possible to construct a connector 54 and complementary connector 56 that magnetically couple together regardless of the orientation of one with respect to the other.

In the embodiment of connector 54 shown in FIG. 2, housing 60 and face 66 of connector 54 are configured such that no significant frictional engagement will hold connector 54 to its complementary connector 56 (not shown). That is, there are no walls, or other surfaces, of any significant size in connector 54 that are brought into significant frictional engagement with other walls, or surfaces, of complementary connector 56 such that, detaching connector 54 from complementary connector 56 requires, in addition to the force necessary to overcome the magnetic coupling of magnets 64, a significant amount of force to overcome the frictional engagement of such walls, or other surfaces.

While face 66 of connector 54 in FIG. 2 includes a recessed area 72 out of which pins 58 extend, and this recessed area 72 is defined by a rectangular wall 74, wall 74 does not come into physical contact with any wall, or other surface, of complementary connector 56 when connector 54 is coupled to connector 56. Rectangular wall 74 therefore does not create any frictional coupling between connectors 54 and 56. Similarly, while connector 54 includes a peripheral wall 76 that extends about the periphery of face 66, peripheral wall 76 does not get enveloped, partially or wholly, or otherwise come into contact with, any corresponding walls or surfaces of complementary connector 56 when connectors 54 and 56 are coupled together. Peripheral wall 76 therefore does not create any frictional coupling between connectors 54 and 56 when they are connected together.

Finally, in the embodiment shown in FIG. 2, magnets 64 are shown as extending forwardly from face 66, thereby exposing a circumferential surface 78 of magnets 64. Circumferential surface 78, however, does not come into any frictional contact with any corresponding surfaces of complementary connector 56. Indeed, the positioning of magnets 64 in connector 54 could be modified from that shown in FIG. 2 such that the outer face of the magnets 64 was flush with face 66.

In summary, in the embodiment shown in FIG. 2, there are no surfaces in contact with each other in connectors 54 and 56 that have planes which are oriented transversely to the direction in which connectors 54 and 56 are pulled apart and/or connected together (e.g. direction 62 in FIG. 2). Thus, whatever surfaces of the connectors 54 and 56 that are in contact with each other are pulled apart from each other by withdrawing the surfaces away from each other, and there is no sliding, whether partial or wholly, of one surface over another. This leaves the coupling force between connectors 54 and 56 as a purely magnetic coupling force.

It will be understood by those skilled in the art that connectors 54 and 56 may be modified from a design of purely magnetic coupling to a design that includes varying degrees of frictional coupling in addition to the magnetic coupling. For example, in one embodiment, an outer wall or surface is included on complementary connector 56 that envelops, partially or wholly, peripheral wall 76 in order to help shield the pins and other electrically conductive structures from dirt, debris, or other environmental contaminants. While such enveloping and/or shielding, may involve contact between wall 76 and a corresponding surface of complementary connector 56, the construction of wall 76 and the corresponding surface can be configured such that any frictional coupling therebetween will be insignificant. More particularly, the design will be such that any such frictional coupling is overcome regardless of which direction a separating force is applied between connector 54 and complementary connector 56. In this manner, if connectors 54 and 56 are not deliberately separated by a person, but instead, for example, are separated due to the person forgetting to separate the two before moving support apparatus 20 while cable 48 is plugged into an outlet, the random and sudden separating force that will be applied when the cable "catches" will not cause damage to either connector 54 or connector 56 due to the overlapping of peripheral wall 76 in connector 54 by a corresponding surface in complementary connector 56. Thus, to the extent there is any frictional coupling between connectors 54 and 56, they may be designed such that the frictional coupling may be overcome without damage regardless of the suddenness and/or random direction in which a separating force may be applied between the two connectors.

Figure 3A:
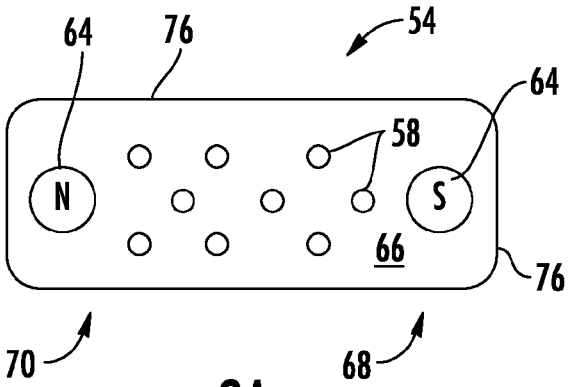
FIG. 3A is an end view of an electrical connector according to a second embodiment.
Figure 3B:
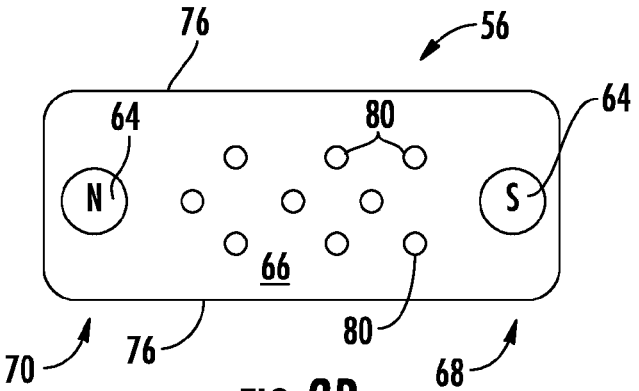
FIG. 3B is an end view of a connector that is complementary to the connector of FIG. 3A.

FIGS. 3A and 3B illustrate another embodiment of connectors 54 and 56. More particularly, FIG. 3A illustrates another embodiment of a connector 54 while FIG. 3B illustrates another embodiment of a complementary connector 56. Complementary connector 56 of FIG. 3B is configured to selectively couple to connector 54 of FIG. 3A. In the embodiment of FIGS. 3A and 3B, connector 54 includes a plurality of pins 58 and a pair of magnets 64, while complementary connector 56 includes a plurality of receptacles 80 and a pair of magnets 64. As was noted previously, it does not matter which of connectors 54 and 56 includes pins and which includes receptacles, nor do either of the connectors 54 and 56 need to exclusively contain only pins or only receptacles (but instead each could include a mix of the two). Further, the location and arrangement of the pins 58 and receptacles 80, as well as the number, orientation, and location of magnets 64 in the embodiment of FIGS. 3A and 3B may be varied from that shown.

A first magnet 64 of connector 54 has its south pole facing outward along first side 68 of connector 54, while a second magnet 64 of connector 54 has its north pole facing outward along second side 70 of connector 54. A first magnet 64 of connector 56 also has its south pole facing outward along a first side 68 of connector 56, while a second magnet 64 of connector 56 has its north pole facing outward along a second side 70 of connector 56. Connectors 54 and 56 will therefore magnetically couple to each other when the south magnetic pole of connector 56 is aligned with the north magnetic pole on second side 70 of connector 54 and the north magnetic pole of connector 56 is aligned with the south magnetic pole on first side 68 of connector 54. In other words, first side 68 of connector 54 must be aligned with second side 70 of complementary connector 56 in order to couple connectors 54 and 56 together. If first side 68 of connector 54 is aligned with first side 68 of complementary connector 56, the four magnets will repel each other, and connectors 54 and 56 will not stay together.

In the embodiment shown in FIGS. 3A and 3B, faces 66 of each connector 54 and 56 are generally flat (except for pins 58 and receptacles 80). Further, neither connector 54 nor connector 56 include any walls or other surfaces that would envelope, overlap, or otherwise frictionally engage the peripheral walls 76 of either connector 54 and 56. In this manner, connectors 54 and 56 of FIGS. 3A and 3B are retained together purely by the magnetic coupling of magnets 64. It will be understood, however, that, as with any of the connector embodiments described herein, modifications could be made to either or both of connectors 54 and/or 56 to include one or more walls or surfaces that engage each other such that some amount of frictional force must be overcome to separate connector 54 from connector 56. In general, such frictional force should small enough such that it is not strong enough to overcome the magnetic repulsion that is created when connectors 54 and 56 are brought into contact with each other with the magnetic poles misaligned (i.e. with like poles next to like poles). In other words, any frictional coupling between the two connectors 54 and 56 should be weak enough such that, if the connectors are misaligned, the magnetic repulsive forces will overcome any frictional retention forces that can be created between connectors 54 and 56. In this manner, the magnets 64 will prevent coupling of connectors 54 and 56 in a misaligned manner.

Figure 4:
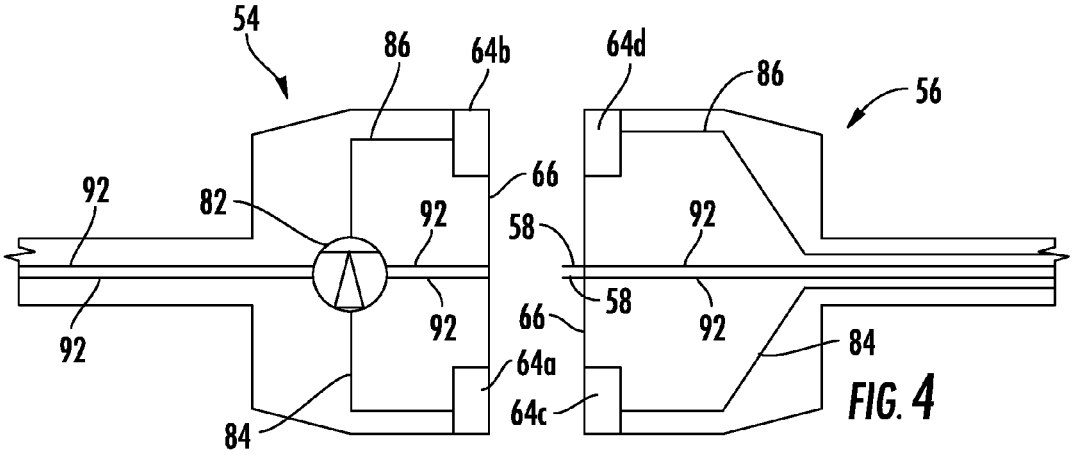
FIG. 4 is a plan view diagram of a pair of connectors according to a third embodiment that have a connection indicator and that are shown in a separated state.
Figure 5:
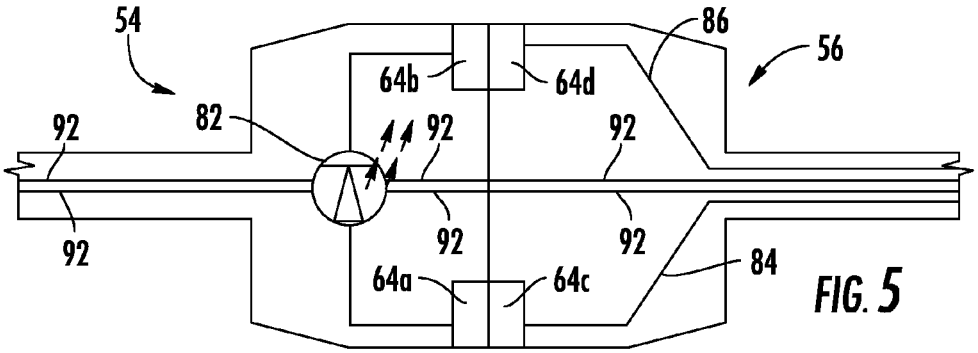
FIG. 5 is a plan view diagram of the pair of connectors of FIG. 4 shown in a connected state.

FIGS. 4 and 5 illustrate schematic diagrams of yet another embodiment of connectors 54 and 56. In the embodiment shown therein, connector 54 includes a connection confirmation indicator 82 that provides an indication to a user that a successful electrical connection has been established between connector 54 and complementary connector 56. It will be understood that, while confirmation indicator 82 is shown integrated into connector 54, it could alternatively be integrated into complementary connector 56. In the embodiment of FIGS. 4 and 5, confirmation indicator 82 is a light emitting diode (LED). It will be understood by those skilled in the art that other types of confirmation indicators could also be provided, such as aural confirmations indicator, or other types of visual indicators.

Confirmation indicator 82 includes a first conductor 84 electrically coupled to a first magnet 64*a* and a second conductor 86 electrically coupled to a second magnet 64*b*. First magnet 64*a* is positioned and configured to make physical contact with a first magnet 64*c* on complementary connector 56, while second magnet 64*b* is positioned and configured to make physical contact with a second magnet 64*d* on complementary connector 56. First magnet 64*c* of connector 56 is electrically coupled to a first conductor 88 inside connector 56, and second magnet 64*d* of connector 56 is electrically coupled to a second conductor 90 inside connector 56. First and second conductors 88 and 90, in turn, are electrically coupled to a source of electrical power (not shown). The source of electrical power may be of nominal voltage, such as five volts or less, or it may be of a different voltage. By supplying an electrical voltage to first and second conductors 88 and 90, LED 82 will illuminate when connectors 54 and 56 are brought into contact with each other and with the right alignment (i.e. magnets 64*a* and 64*c* touch each other, and magnets 64*b* and 64*d* touch each other). LED 82 therefore provides a visual indication when connectors 54 and 56 are connected together.

When connected together (FIG. 5), electrical power and/or data may be transmitted between connectors 54 and 56 via a pair of conductors 92. Conductors 92 are positioned to align with each other, and make a physical and electrical connection with each other, respectively, when connectors 54 and 56 are coupled together. It will be understood that, while FIGS. 4 and 5 illustrate an embodiment of connectors 54 and 56 having only two conductors 92, this can be varied to include a greater or lesser number of conductors 92. The connection of conductors 92 from one connector 54 to the other connector 56 may take place via pins 58 and receptacles 80, or by other means. As shown in FIGS. 4 and 5, conductors 92 of complementary connector 56 terminate in pins 58 that extend outward from face 66. This can be varied.

Figure 6:
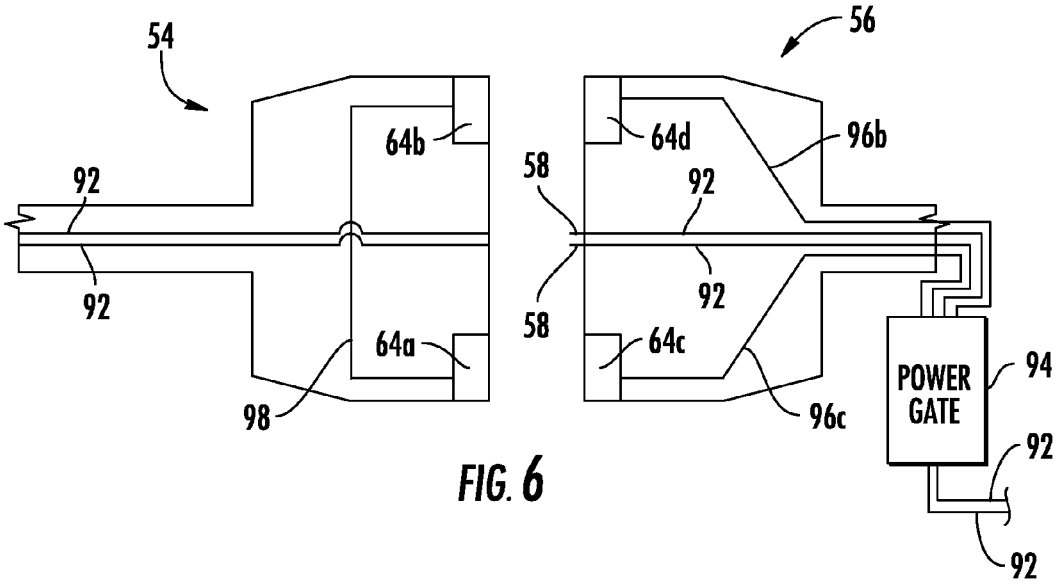
FIG. 6 is a plan view diagram of a pair of connectors according to a fourth embodiment that have a power switch and that are shown in a separated state.

FIG. 6 illustrates yet another embodiment of a connector 54 and complementary connector 56. In this embodiment, complementary connector 56 includes a power switch or gate 94 that, in the embodiment shown, is physically separated from housing 60 of connector 56. It will be understood, however, that in some embodiments power gate 94 is incorporated inside of housing 60 of connector 56. It will also be understood that power gate 94 could alternatively be incorporated into connector 54 instead of complementary connector 56 in some embodiments.

Power gate 94 operates to keep any high voltage and/or high current pins 58 on complementary connector 56 from being powered until after the connector 56 is coupled to connector 54. Power gate 94 automatically senses this connection and thereafter turns on power to the one or more conductors 92, or other conductors, that carry high voltage and/or high current. In this manner, power gate 94 acts as a safety device that helps to prevent short circuiting of any of the pins 58 thereon when inadvertent contact may be made between the pins 58 and objects other than connector 54. For example, if a person happens to accidentally make contact with any of the pins 58, any high voltage or high current-carrying pins will be shut off so that such contact will have no effect on the user. However, once the proper connection is made between connector 56 and connector 54, power is turned on to these pins, thereby enabling the desired transfer of power and/or data between connectors 54 and 56.

Power gate 94, in the embodiment shown in FIG. 6, receives power and/or data from a pair of conductors 92 that feed into power gate 94. Conductors 92 also pass through power gate 94 and are delivered to pins 58 of connector 56. Power gate 94 either taps into the power in one or both of conductors 92, or it receives electrical power from another source (not shown). In either case, power gate 94 delivers a voltage to one of two conductors 96*a* and 96*b*. Conductors 96*a* and 96*b*, in turn, deliver the voltage to one of magnets 64*c* or 64*d*. This voltage is of a magnitude that is less than the voltage supplied to one or both of conductors 92. That is, the voltage supplied to magnets 64*a, b, c*, and/or *d* is of such a relatively small magnitude that it will not cause any electrical shocks, or create any significant risks of sparking, or other hazards, if any of magnets 64*a, b, c*, or *d* make inadvertent contact with a person or an object.

When connector 56 is not coupled to connector 54, there is no electrical communication between magnets 64*c* and 64*d*. However, connector 54 includes a conductor 98 that is coupled between magnets 64*a* and 64*b*. Consequently, when connector 56 is coupled to connector 54, magnets 64*a* and 64*c* are in electrical communication with each other, and magnets 64*b* and 64*d* are in electrical communication with each other, as well as, via conductor 98, magnets 64*a* and 64*c*. A complete circuit is therefore established that electrically joins conductors 96*a* and 96*b*. This completion of the circuit is detected by power gate 94, which then switches on the higher voltage and/or higher current power to one or more of conductors 92. The detection of this circuit completion and the switching on and off of power to conductors 92 may be carried out in various known manners, as would be known to one or ordinary skill in the art. In one example, power gate 94 may include one or more Metal Oxide Semiconducting Field Effect Transistors (MOSFETs) that are used to control the switching on and off of power to conductors 92. Other structures may be used.

The power carried over conductors 92, as well as conductors 96*a* and 96*b* may be either direct current (DC) or alternating current (AC). In some embodiments, conductors 96*a* and 96*b* are electrically coupled to their own pins 58 (not shown) rather than to magnets 64*c* and 64*d*. In such a case, connector 54 includes corresponding receptacles that are electrically connected together by conductor 98. In this manner, a complete circuit is formed connecting conductors 96*a* and 96*b* together when connectors 54 and 56 are coupled together. This alternative design avoids using any of the magnets as electrical conductors, which may be desirable in some instances.

In yet another alternative embodiment, any one or more of magnets 64*a, b, c*, and/or *d* could be replaced with electromagnets that are selectively energized by a controller in electrical communication therewith. The controller could be contained within housings 60 of either or both of connectors 54 and 56, or it could be positioned elsewhere.

While FIGS. 2-6 have illustrated several different physical configurations and features that may be incorporated into connectors 54 and/or 56, it will be understood by those skilled in the art that other types of physical configurations may be utilized, and that other features may be incorporated into, or combined with, those shown in FIGS. 2-6. For example, it will also be understood that confirmation indicator 82 could be incorporated into a connector 54, 56 pair having power gate 94, such as the embodiment shown in FIG. 6. When so incorporated, confirmation indicator 82 could be positioned in either of connectors 54 or 56. If included in connector 54, indicator 82 could be placed in electrical series with conductor 98. If included in connector 56, indicator 82 could be placed in electrical series with either of conductors 96*a* or 96*b*.

As another example, any of the connector embodiments of FIGS. 2-6 could be modified to have the same pins and/or protocols as any existing standard connectors. Thus, for example, any of the connectors 54, 56 of FIGS. 2-6 could be modified to transmit universal serial bus (USB) signals by having the same number of pins as a USB connection, and communicating via the same protocols as USB. Such USB connectors would have the added benefit of magnetic coupling via magnets 64 such that the primary coupling force between the two connectors was magnetic, rather than frictional. In other embodiments, the confirmation indicator 82 feature of FIGS. 4-5 and/or the power gate feature 94 of FIG. 6 could be added to the connectors 54, 56 that implement USB communication. The USB communication could include USB 1.0, USB 2.0, as well as USB 3.0 (which includes SuperSpeed bus), and other variants of USB. Still other types of standard communication could be implemented via connectors 54 and 56 besides USB, such as, but not limited to, RS-232, RS-485, Firewire (IEEE 1394), Ethernet, and still others. Indeed, as will be discussed in greater detail below, connectors 54, 56 may be designed to facilitate or implement one or more specific types of field bus communications or other types of communication, such as, but not limited to, Controller Area Network, Local Interconnect Network (LIN), LONWorks, SPI, $I^2C$, System Management Bus (SMBus) or others.

Figure 7:
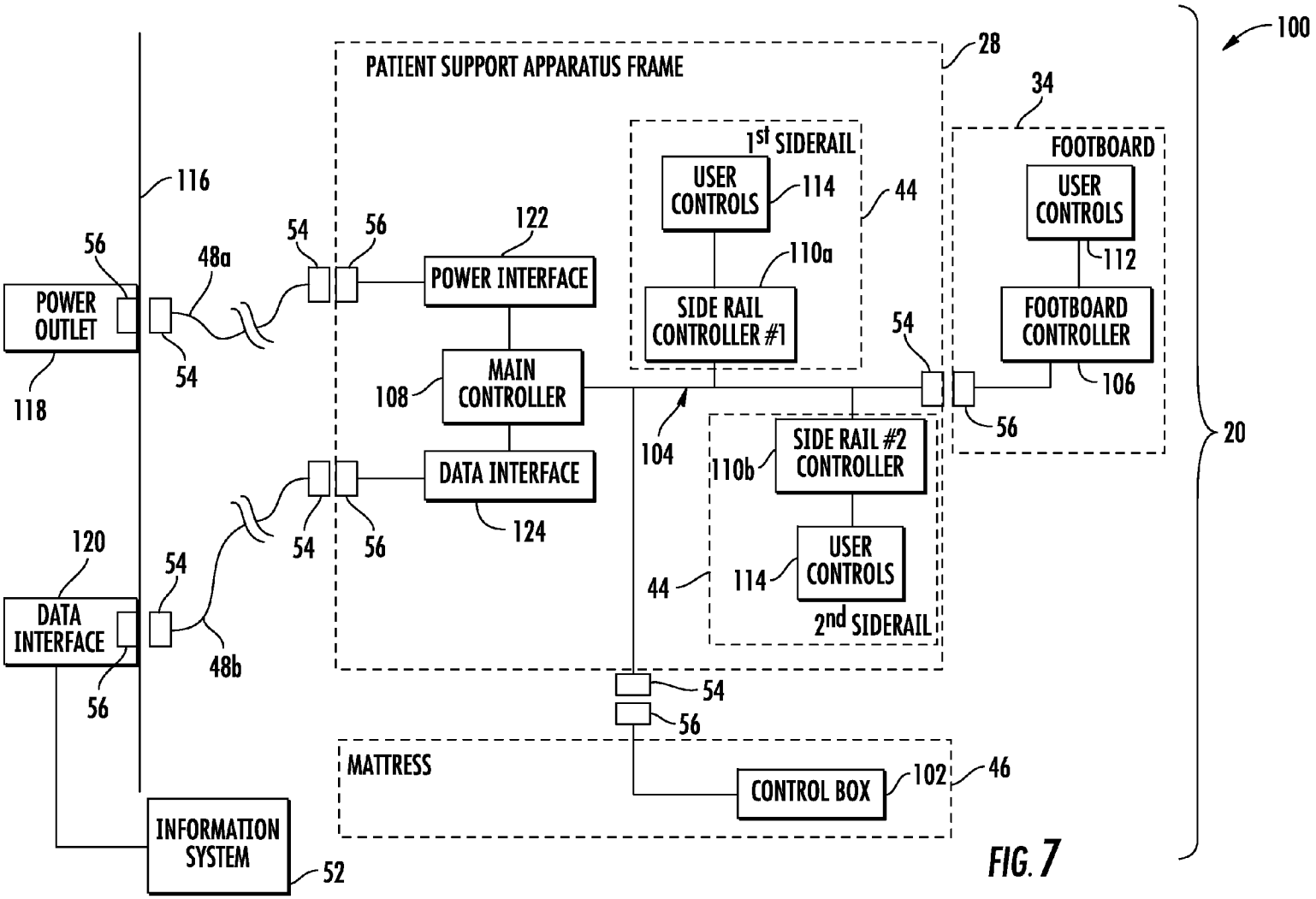
FIG. 7 is a schematic diagram of a patient support apparatus having an arbitrary configuration of connectors.
Figure 8:
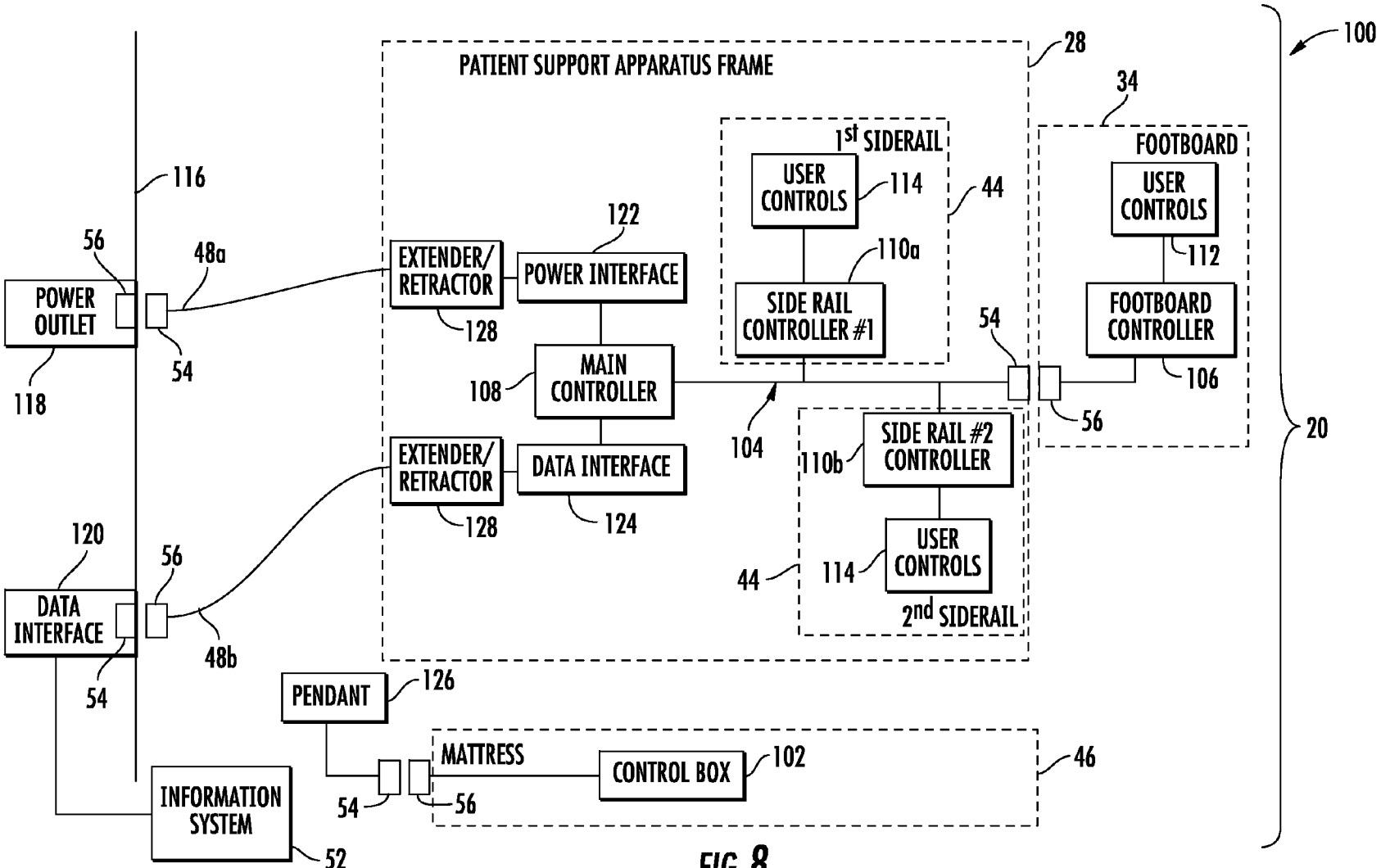
FIG. 8 is a schematic diagram of a patient support apparatus having a configuration of connectors and components different from the example of FIG. 7.

FIGS. 7 and 8 schematically illustrate a pair of environments or applications 100 in which in which one or more connector 54 and connector 56 pairs are used with and/or integrated into different support apparatuses 20. As will be discussed in more detail below, any of the number, placement, and functions of connector 54, 56 pairs shown in FIGS. 7 and 8 may be varied from the specific examples shown in these environments 100. Thus, for example, environment 100 of FIG. 7 could be modified so that only a single connector pair 54, 56 was present between control box 102 (discussed below) and a communications network 104 integrated into the frame 28 of patient support apparatus 20, and all of the other connector 54, 56 pairs were replaced with different types of connectors. Alternatively, the environment 100 of FIG. 7 could be modified so that only one of the other connector 54, 56 pairs shown therein was present, or any subset of the connector 54, 56 pairs that is shown therein. Of course, additional connector pairs could also be added beyond those shown in FIG. 7 or 8.

In the environment 100 of FIGS. 7 and 8, a patient support apparatus 20 is shown having a frame 28 and a mattress 46. While not shown, patient support apparatus 20 of FIGS. 7 and 8 may also include base 22 (with or without wheels 24), and one or more elevation adjustment mechanisms 26 that allow frame 28 to be raised and lowered with respect to base 22, as well as to have its orientation changed with respect to base 22. Other structures beyond those shown in FIGS. 7 and 8 may also be included within patient support apparatus 20.

In the embodiment shown in FIG. 7, patient support apparatus 20 includes an internal communications network 104 that electrically couples a plurality of controllers together for sharing power and/or communication. The precise implementation of communication network 104 may vary, but in one embodiment, network 104 may be a Controller Area Network (CAN). In other embodiments, network 104 may be an Ethernet network, a LONWorks network, a Local Interconnect Network (LIN), a Firewire network, or still other types of networks. Communications network 104 includes a number of controllers or internal nodes that are in communication with each other over the internal network 104. These include a footboard controller 106, a main controller 108, a first side rail controller 110*a*, and a second side rail controller 110*b*. Control box 102 in mattress 46 also includes a controller that is in communication with network 104. Before describing in further detail the structure and functions of these controllers, it should be pointed out that patient support apparatus 20 could alternatively be designed without any internal communications network, but instead have various controllers communicate with each other in a non-networked manner, or by combining the functions of these various controllers into one controller that handles all of these tasks, or in still other manners that do not utilize any sort of communications network on the patient support apparatus 20. Still further, when a network 104 is used, the number of controllers in communication with that network 104 could be modified from that shown in FIGS. 7 and 8 to include fewer or greater numbers of controllers.

Each controller, whether controller 106, 108, 110*a*, 110*b*, or the controller inside of control box 102, that communicates over internal communications network 104 includes one or more microprocessors, microcontrollers, field programmable gate arrays, systems on a chip, volatile or nonvolatile memory, discrete circuitry, and/or other hardware, software, or firmware that is capable of carrying out the functions described herein, as would be known to one of ordinary skill in the art.

Footboard controller 106 oversees a set of user controls 112 that are incorporated into footboard 34. User controls 112 include a plurality of buttons, one or more display screens, one or more touch screens, one or more lights or other visual indicators, as well as additional control items and/or indicators, or any combination of such controls items or indicators. Such user controls allow a caregiver to control operation of various aspects of patient support apparatus 20, such as raising and lowering frame 28, pivoting of one or more of deck sections 36, 38, 40, and/or 42, setting alerts and/or reminders, controlling the brake, and controlling still other aspects of support apparatus 20. Footboard controller 106 is in communication with user controls 112 and forwards the necessary commands and/or data onto network 104 so that the desired operations and/or changes are made in response to the user's manipulation of user controls 112.

In many conventional patient support apparatuses, it is customary to have a footboard, such as footboard 34, that is physically removable from the support apparatus 20. This selective attachment of footboard 34 to frame 28 allows the footboard to be removed if a patient's height is greater than, or nearly as long as, the length of mattress 46 such that the patient supported thereon may otherwise be uncomfortable with footboard 34 attached to frame 28. Alternatively, footboard 34 may be desirably removed when therapy is being performed on the patient supported on apparatus 20, or when footboard 34 otherwise acts as an undesirable obstacle.

Regardless of the reasons for removing footboard 34 from frame 28, it is necessary for an electrical connection to be established between footboard controller 106 and communications network 104 when footboard 34 is coupled to frame 28 so that the support apparatus 20 reacts properly to the manipulation of user controls 112. As shown in FIGS. 7 and 8, this selective coupling and uncoupling of footboard controller 106 to network 104 is carried out by way of a connector 54, 56 pair. Connector pair 54, 56 between footboard controller 106 and network 104, as well as any other connector pairs 54, 56 in FIGS. 7 and 8, may be configured in any of the manners described above, including, but not limited to, the embodiments shown in FIGS. 2-6. Further, while FIGS. 7 and 8 specifically identify a position of connector 54 and a position of connector 56 in each of the connector pairs, it will be understood by those skilled in the art that these positions can be reversed for any one or more of these connector pairs. That is, the precise location of connector 54 versus connector 56 can be flipped. In the example of FIG. 7, for example, connector 54 is shown integrated into frame 28 while complementary connector 56 is shown integrated into footboard 34, but this could be reversed such that connector 54 was integrated into footboard 34 and complementary connector 56 was integrated into frame 28.

If communications network 104 is a Controller Area Network, the connectors 54 and 56 between frame 28 and footboard 34 are constructed to include at least four pins: one pin for CAN High signals, one pin for CAN low signals, one pin for power, and one pin for ground. Additional wires or conductors 92 may be included as well. Further, if communications network 104 is of a type different than CAN, a different number of pins are included in connectors 54 and 56 that match the particular communication protocol used by network 104. Connectors 54 and 56 of frame 28 and footboard 34, as was mentioned previously, may include any one or more of the features discussed above, including, but not limited to, a confirmation indicator 82 and a power gate 94.

In the context of electrically connecting footboard 34 to frame 28, it may be advantageous to use a connector 54, 56 pair that has no significant amount of frictional retention between the two connectors when connected, but instead relies primarily upon magnetic coupling between one or more magnet 64 pairs. This is because the footboard 34 and frame 28 may be constructed such that the physical connection between the two and the electrical connection are established at the same time. That is, rather than physically coupling footboard 34 to frame 28 and then subsequently electrically coupling connector 54 and 56 together, or vice versa, the footboard 34 and frame 28 are brought into physical and electrical contact nearly simultaneously. This may be carried out by having a pair of vertical alignment posts (not shown) built into the foot end of frame 28 that extend into corresponding slots defined in the bottom of footboard 34. Connector 56 may also be built into the bottom of footboard 34 and connector 54 may be positioned on an upwardly facing surface near the alignment posts such that, when footboard 34 is pushed downward on the alignment posts to its full extent, connectors 54 and 56 simultaneously are brought into electrical and magnetic contact with each other.

In some embodiments, it may be desirable to leave the physical connection of connector 56 to footboard 34 slightly loose, as well as the physical connection of connector 54 to frame 28, so that both have a little play to enable them to automatically move into alignment with each other via the magnetic forces when connecting footboard 34 to frame 28. This is helpful because the alignment posts often still leave a certain amount of variance in the physical alignment of footboard 34 to frame 28. Because of this, a user who exerted a downward force on footboard 34 might find that, despite the insertion of the alignment posts of frame 28 into the corresponding slots on footboard 34 (or vice versa), connectors 54 and 56 were not precisely aligned. Were such connectors each tightly coupled to their respective underlying structure (i.e. frame 28 and footboard 34, respectively), they might not make a proper or complete electrical connection. Further, were connectors 54 and 56 to include a substantial frictional component in their coupling, it might be necessary to separately manipulate by hand one or both of these connectors 54 and 56 to bring them into alignment and/or to prevent physical damage to either one that could otherwise occur if they were misaligned and excessive compressive force were applied between the two. However, by designing connectors 54 and 56 to be primarily magnetically coupled, a user can connect footboard 34 to frame 28 without having to touch or individually move either connector into alignment with each other—he or she can simply line up the footboard with the frame, push the footboard down onto the frame, and connectors 54 and 56 will automatically couple to each other due to the magnetic forces creating any necessary adjustments in physical alignment between the two.

In the patient support apparatus 20 shown in FIG. 7, one or more other connector 54, 56 pairs may be included therein, or included in lieu of the connector pair between footboard 34 and frame 28. As shown in FIG. 7, patient support apparatus 20 includes a connector 54, 56 pair between network 104 and the control box 102 of a mattress 46, and it includes one or more connector 54, 56 pairs between support apparatus 20 and one or more electrical cables 48*a* and/or 48*b*. These are discussed in more detail below.

Each side rail 44, if included on patient support apparatus 20, may include a side rail controller 110 that is in electrical communication with an attached set of user controls 114. User controls 114 include a plurality of buttons, one or more display screens, one or more touch screens, one or more lights or other visual indicators, as well as additional control items and/or indicators, or any combination of such controls items or indicators. Such user controls allow a caregiver and/or patient to control operation of various aspects of patient support apparatus 20, such as raising and lowering frame 28, pivoting of one or more of deck sections 36, 38, 40, and/or 42, and/or contacting or communicating with a remotely positioned caregiver. In general user controls 114 provide a subset of the control options included with user controls 112 on footboard 34. Each side rail controller 110 is in communication with its respective user controls 114 and forwards the necessary commands and/or data onto network 104 so that the desired operations and/or changes are made in response to the user's manipulation of user controls 112. These desired operations may be carried out by a main controller 108 that oversees the physical movement of support apparatus 20, or they may be carried out by other controllers (not shown) that are included within support apparatus 20 and are connected to network 104.

As shown in FIG. 7, communications network 104 is selectively coupled to a control box 102 within mattress 46 by way of a pair of connectors 54 and 56. Control box 102 includes a controller for overseeing the inflation and deflation of one or more fluid bladders within mattress 46, and/or for overseeing the operation of one or more patient turning structures (such as, but not limited to, fluid bladders) within mattress 46, and/or for overseeing other operations. One example of such a control box is disclosed in commonly assigned. U.S. patent application Ser. No. 61/697,010 filed Sep. 5, 2012 by Patrick Lafleche and entitled PATIENT SUPPORT, the complete disclosure of which is hereby incorporated herein by reference. Because the control of one or more of the features of mattress 46 is carried out in response to manipulation of one or more of the controls of user controls 112 and/or user controls 114, and because it may be desirable for control box 102 to communicate with main controller 108, and vice versa, and/or with other controllers on network 104, it is useful to have an electrical connection between mattress 46 and support apparatus 20.

Connector 54 and complementary connector 56 may be used for providing the electrical connection between mattress 46 and frame 28 of support apparatus 20. By using connectors 54 and 56 which are primarily magnetically coupled, any damage that might otherwise occur when a caregiver attempted to lift and/or remove mattress 46 from frame 28 without first remembering to disconnect the electrical connection therebetween, can be reduced or eliminated. As with connectors 54 and 56 between frame 28 and footboard 34, connectors 54 and 56 between frame 28 and mattress 46 are designed to have a specific number of conductors that correspond to the type of communication protocol of network 104. Thus, for example, if network 104 is a CAN network, connectors 54 and 56 between mattress 46 and frame 28 includes at least four pins: one pin for CAN High signals, one pin for CAN low signals, one pin for power, and one pin for ground. Additional wires or conductors 92 may be included as well. Further, if communications network 104 is of a type different than CAN, a different number of pins may be included in connectors 54 and 56 that match the particular communication protocol used by network 104. Connectors 54 and 56 of frame 28 and mattress 46, as was mentioned previously, may include any one or more of the features discussed above, including, but not limited to, a confirmation indicator 82 and a power gate 94. Still further, in some embodiments, the connectors used between mattress 46 and frame 28 may omit magnetic coupling and use conventional frictional fit coupling in combination with either or both confirmation indicator 82 or power gate 94.

Environment 100 of FIG. 7 illustrates yet another possible application of connectors 54 and 56 in connection with a patient support apparatus: one or more electrical cables 48*a* and 48*b* that communicate power and/or data to and/or from patient support apparatus 20 and external structures. In the embodiment shown in FIG. 7, there is a power cable 48*a* and a data cable 48*b*. It will be understood by those skilled in the art that, in some embodiments, a single cable could be used that provided both power and data communication, while in other embodiments, multiple cables could be used in which each individually communicated both power and data.

As shown in FIG. 7, a wall or headwall unit 116 is included in environment 100 that has a power outlet 118 and a data interface 120 built into it, or otherwise attached thereto. Power outlet 118 is a conventional power outlet that supplies electricity to selected electrical devices, such as a conventional 120 volt, 60 hertz AC source of power. In some countries, power outlet 118 supplies different levels of AC voltage at different frequencies, such as, but not limited to, 220-240 volts at 50 hertz. Regardless of the voltage and frequency, power cable 48*a* provides an electrical connection between patient support apparatus 20 and power outlet 118. Power cable 48*a*, as shown in FIG. 7, includes a connector 54 or 56 at both of its ends. It will be understood by those skilled in the art that, in some embodiments, cable 48*a* could be modified to include a connector 54 or 56 at only a single one of its ends. The other end could include a conventional connector, or it could be integrated into the structure to which it was attached (e.g. patient support apparatus 20).

Connectors 54 and 56 of power cable 48*a* may take on any of the forms and configurations discussed above, and operate to transfer electrical power from outlet 118 to a power interface 122 within support apparatus 20. Power interface 122 includes one or more rectifiers, transformers, and/or other components that convert the received voltage level into those appropriate for patient support apparatus 20, and/or convert the AC to DC. Power interface 122 then supplies power to all of the electrical components on patient support apparatus 20, including, but not limited to, main controller 108. Main controller 108 may also be in communication with power interface 122 and oversee one or more aspects of its operation.

Data cable 48*b*, as with power cable 48*a*, is shown in FIG. 7 as including a connector 54 or 56 at both of its ends. It will be understood by those skilled in the art that, in some embodiments, data cable 48*b* could be modified to include a connector 54 or 56 at only a single one of its ends. The other end could include a conventional connector, or it could be integrated into the structure to which it was attached (e.g. patient support apparatus 20). Data cable 48*b* communicates data between patient support apparatus 20 and data interface 120. Data interface 120 is any electrical or electronic structure that is in communication with, or allows communication with, information system 52. Data interface 120 may, for example, be a nurse call system outlet, in some embodiments. In other embodiments, data interface 120 is an Ethernet port, a router, a network gateway, or any other type of network device that allows communication with information system 52, which itself may be an Ethernet, or other type of network.

In some embodiments, information system 52 is a local area network that has access to the Internet, so that patient support apparatus 20 is able to communicate data over the Internet. In other embodiments, information system 52 is a healthcare communication network (such as one or more Ethernets) having a plurality of applications and/or servers operating in communication with the network. These may include conventional Admission, Discharge, and Transfer (ADT) systems, electronic medical records systems (EMR), nurse call systems, wireless communications systems, work flow systems, locating-and-tracking systems, and other systems.

Data cable 48*b* is electrically coupled to a data interface 124 within patient support apparatus 20. Data interface 124 converts the electrical signals transmitted over cables 48*b* from one protocol or format into another, such as that used on internal communication network 104, or to another type. In some embodiments, data interface 124 may be integrated within main controller 108, or another controller.

Connectors 54 and 56 of data cables 48*a* and 48*b*, as with any of the connectors 54, 56 of FIGS. 7 and 8, may include any one or more of the features discussed above with respect to connectors 54 and 56. Thus, for example, in addition to magnetic coupling, connectors 54 and 56 may include a confirmation indicator 82 and/or a power gate 94.

FIG. 8 illustrates another environment 100 in which one or more connectors 54 and 56 may be used. In the environment of FIG. 8, structures bearing the same functionality as those of FIG. 7 are identified with common reference numbers, and are not described further. Patient support apparatus 20 of FIG. 8 differs from patient support apparatus 20 of FIG. 7 in two primary ways. First, support apparatus 20 of FIG. 8 does not include any connectors for communicating with mattress 46. Instead, mattress 46 is controlled by a separate stand-alone pendant 126. Second, support apparatus 20 is coupled to a pair of cables 48*a* and 48*b* that have one end integrated into support apparatus 20. Further, this integrated end of cables 48*a* and 48*b* may be coupled to one or more automatic extenders/retractors 128. Automatic extenders/retractors 128 may be of a conventional type, such as, but not limited to, extenders and retractors commonly found on vacuum cleaners wherein the cords are stored in a housing in a coiled manner. A user can extend the cord out of the housing by pulling on the cord. To have the cord automatically retract, a small sudden force is applied to the cord, and a retractor will automatically urge the cord to retract inward and coil itself back up again. Patient support apparatus 20 of FIG. 8 may include one or more of such extender/retractors so that cables 48*a* and/or 48*b* may be easily extended out of support apparatus 20 and retracted therein when not needed. This provides the added benefit of cables 48*a* and/or 48*b* having an exposed length only as long as is necessary to ensure a proper connection to outlet 118 and/or interface 120, thereby reducing cord/cable clutter. While not shown in FIG. 7, the embodiment of patient support apparatus 20 could be modified to include one or more extender/retractors 128, either for one or more of cords 48*a* and 48*b*, and/or for connection between mattress 46 and support frame 28.

Pendant 126 may be a conventional pendant 126 that is used to control the operation of mattress 46. By using a connector 54, 56 pair between pendant 126 and mattress 46, the possibility of damage to either pendant 126 or mattress 46 can be reduced or eliminated if one is moved with respect to the other prior to disconnecting the two. In some instances, pendant 126 communicates with control box 102 using the same type of network and/or protocol as network 104. In such instances, connectors 54 and 56 are configured to include the requisite number of pins and/or conductors that support the chosen communication protocol (e.g. CAN, LIN, SPI, or others).

In the examples shown in both FIGS. 7 and 8, multiple different positions for connectors 54 and 56 are shown. It will be understood that, in addition to changing the location of these connectors, and/or reducing or increasing the number of connectors 54, 56 in a given environment, the individual configuration of connectors 54 and 56 can vary for a given environment 100. In other words, for example, connectors 54 and 56 that connect mattress 46 to frame 28 (in either of FIG. 7 or 8) could be different from connectors 54 and 56 that couple support apparatus 20 to power outlet 118, or connectors 54 and 56 that couple support apparatus 20 to data interface 120. Such differences could include the number of conductors and/or pins, the physical size, the shape, the electrical characteristics (e.g. voltages and/or current carrying limits), as well as the layout, number, types, and/or strengths of magnets 64 that may be present in the connectors 54, 56. Such differences could also include the presence and/or absence of confirmation indicator 82 and/or power gate 94 in some or all of the connectors 54, 56.

While connectors 54 and 56 have been described above in detail as including structures for making physical and electrical contact with each other (e.g. pins 58 and receptacles 80), it will be understood by those skilled in the art that the concepts of connectors 54 and 56 could be applied to communicating structures that wirelessly communicate with each other in a manner in which the two communicating structures are ideally positioned near to each other in a controlled orientation, such as, for example, near field communication and/or inductive coupling. Thus, for example, magnets 64 could be included in a first housing that includes a first coil and a second housing that includes a second coil wherein the two coils transfer power and/or data inductively, or in which the two coils communicate with each other using near field communication. The presence of one or more pairs of magnets 64 therefore can be added, as another example, to the inductive coupling disclosed in commonly-assigned, copending U.S. patent application Ser. No. 13/296,656 filed Nov. 15, 2011 by applicants Guy Lemire et al. and entitled PATIENT SUPPORT WITH WIRELESS DATA AND/OR ENERGY TRANSFER, the complete disclosure of which is hereby incorporated herein by reference. As a more specific example, one or more magnets 64 can be incorporated into the coil housings 52 and 54 disclosed therein to help align, and maintain, the alignment of the inductively communicating coils, although other manners of incorporating the teachings of the present application into the devices disclosed therein are possible. When modified to include magnets, one or both of housings 52 and 54 could be further modified with some physical mobility relative to its underlying base structure so that the magnetic forces of the magnets could move, as necessary, one or both of housings 52 and 54 into proper alignment without having to move the entire underlying base structure.

Various additional alterations and changes can be made from any of the various embodiments described herein without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

What is claimed is:

1. A patient support apparatus comprising:

a patient support surface adapted to support a patient thereon;

an electrical control system adapted to control a plurality of features of the patient support apparatus;

an electrical connector in electrical communication with said electrical control system, said electrical connector integrated into a mattress positioned on said patient support apparatus, and said electrical connector adapted to releasably couple to a complementary connector in order to transfer electrical power therebetween, the complementary connector being electrically coupled to a pedestal that is supportable on the patient support apparatus wherein said pedestal provides a user interface adapted to allow a user to control at least one aspect of the electrical control system; and a magnet incorporated into said electrical connector, said magnet adapted to releasably hold said electrical connector and the complementary connector together via magnetic coupling and to assist in aligning said electrical connector and the complementary connector.

2. The patient support apparatus of claim 1 wherein said electrical connector includes a north magnetic pole and a south magnetic pole, said north magnetic pole adapted to releasably couple to a complementary south magnetic pole in the complementary connector, and said south magnetic pole adapted to releasably couple to a complementary north magnetic pole in the complementary connector in order to hold said electrical connector and the complementary connector together when the north and south magnetic poles are aligned with the complementary south and north magnetic poles, respectively, and to resist coupling the electrical connector and the complementary connector together when the north and south magnetic poles are not aligned with the complementary south and north magnetic poles, respectively.

3. The patient support apparatus of claim 2 wherein said electrical connector and complementary connector are adapted to transfer data therebetween.

4. The patient support apparatus of claim 2 wherein the north magnetic pole is part of a first magnet incorporated into said electrical connector and the south magnetic pole is part of a second magnet incorporated into said electrical connector.

5. The patient support apparatus of claim 2 wherein said north and south poles of the electrical connector are adapted to releasably couple to the complementary south and north magnetic poles such that at least 40 pounds of force are required to separate the electrical connector from the complementary connector.

6. The patient support apparatus of claim 1 wherein said patient support apparatus is one of a bed, a stretcher, a cot, or a recliner.

7. The patient support apparatus of claim 1 wherein said electrical connector and the complementary connector are held together solely by magnetic force and without any friction fitting.

8. The patient support apparatus of claim 1 wherein said electrical connector further includes:

a first conductor;

a second conductor adapted to carry a voltage higher than a voltage carried by said first conductor;

a sensor adapted to detect when said first conductor is electrically connected to the complementary connector; and a switch that turns on electrical power to said second conductor when said sensor detects that the first conductor is electrically connected to the complementary connector and that turns off electrical power to said second conductor when said sensor detects that the first conductor is electrically disconnected from the complementary connector.

9. The patient support apparatus of claim 1 wherein said electrical connector is coupled to an electrical cable, said electrical cable being extendable out of, and retractable into, a housing.

10. The patient support apparatus of claim 9 further including an automatic retraction device that is adapted to automatically retract said electrical cable into the housing when activated by a user.

11. The patient support apparatus of claim 1 further including an indicator that provides a visual indication when said electrical connector and the complementary connector are electrically coupled together.

12. The patient support apparatus of claim 11 wherein said indicator includes a light emitting diode incorporated into said electrical connector, said light emitting diode adapted to emit light when said electrical connector and the complementary connector are electrically coupled together.

* * * * *